US006412729B2

(12) United States Patent
Kury et al.

(10) Patent No.: US 6,412,729 B2
(45) **Date of Patent: *Jul. 2, 2002**

(54) REWINDER MANDREL SYSTEM

(75) Inventors: Paul B. Kury, Yorba Linda, CA (US); Craig D. Lacount, Oshkosh, WI (US); Steve G. Sukowatey, Little Rock, AR (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/883,640

(22) Filed: Jun. 18, 2001

Related U.S. Application Data

(63) Continuation of application No. 09/470,653, filed on Dec. 22, 1999, now Pat. No. 6,270,034.

(51) Int. Cl.[7] ..... B65H 19/22

(52) U.S. Cl. ..... 242/533.4; 242/532.2; 242/533.6

(58) Field of Search ..... 242/533.4, 533.5, 242/533.6, 533.7, 559.2, 597.1, 532.2

(56) References Cited

U.S. PATENT DOCUMENTS

| | | | |
|---|---|---|---|
| 1,868,115 | A | 7/1932 | Mulligan |
| 2,567,387 | A | 9/1951 | Link |
| 2,575,631 | A | 11/1951 | Link |
| 3,853,279 | A | 12/1974 | Gerstein |
| 4,133,495 | A | 1/1979 | Dowd |
| 4,611,638 | A | 9/1986 | Matumura |
| 5,337,968 | A | 8/1994 | De Bin et al. |
| 5,452,496 | A | 9/1995 | Long et al. |
| 5,725,176 | A | 3/1998 | Vigneau |
| 5,745,797 | A | 4/1998 | Watkins et al. |
| 5,797,559 | A | 8/1998 | Coffey |

FOREIGN PATENT DOCUMENTS

| | | |
|---|---|---|
| EP | 618159 | 10/1994 |

OTHER PUBLICATIONS

PCT Search Report for Appl. No. PCT/US00/32877; Mar. 1, 2001.

*Primary Examiner*—Emmanuel M. Marcelo
(74) *Attorney, Agent, or Firm*—Dority & Manning, P.A.

(57) ABSTRACT

A rewinder mandrel system for winding paper into rolls on a mandrel is provided. The system includes a turret assembly having at least one mandrel rotatably affixed thereto. The rewinder mandrel system can also include a gas circulation system that can aid in the positioning, loading, and removing of paper or paper cores located on the mandrel. In particular, the gas circulation system can contain one or more gas flow control devices configured to provide positive pressure and a suction force. In one embodiment, a gas flow control device rotatably affixed to the turret interacts with a second stationary gas flow control device to provide air circulation to the mandrels.

14 Claims, 8 Drawing Sheets

REWINDER MANDREL SYSTEM

This application is a continuation of Ser. No. 09/470,653 filed Dec. 22, 1999 now U.S. Pat. No. 6,270,034.

FIELD OF THE INVENTION

The present invention generally relates to a rewinder system, such as the type used to rewind tissues or other paper webs from a supply web onto a core. More particularly, the present invention is directed to a rewinder system having a number of mandrels that can be indexed by a turret assembly. The mandrels can be supplied with vacuum or positive air pressure to aid in the winding process.

BACKGROUND OF THE INVENTION

Various paper products, such as tissues and other paper webs, are typically formed into large supply rolls after being manufactured. In order to commercially utilize paper from these supply rolls, it is necessary to rewind the paper from the large supply roll onto a smaller sized roll, which is generally more useful for commercial purposes. For example, in conventional systems, a core is often placed onto a mandrel that is capable of spinning so that the spinning of the mandrel in conjunction with the core can effectuate winding of the paper thereon.

Techniques for utilizing mandrels for winding paper are generally well known in the art. For example, a turret-style winding system is one well-known method used to wind paper onto a core. Most turret systems include a number of mandrels that are each capable of spinning independently of each other so that multiple paper logs can be formed simultaneously. For example, in some conventional turret systems, a core is first loaded onto a mandrel. After loading, the mandrel and core can be spun so that a sheet of paper can be wound around the core. Once the desired amount of paper is wound onto the core, the core and paper can then be removed.

To effectively utilize a turret-style winding system, such as discussed above, it is generally necessary to ensure that the core remain securely fit onto the mandrel during spinning. If the core moves slightly about the mandrel while the paper is being wound, the paper might improperly wind onto the core, forming an undesirable asymmetrically wound roll.

In the past, various techniques were utilized to keep the core in a fixed position relative to the mandrel. For example, in some systems, mechanically operated dogs that cut into the core were used to maintain the position of the core relative to the mandrel. In order to support such mechanically operated dog systems, it was typically required that the mandrels be made from steel or some other heavy material. However, the use of steel and other heavy materials caused the mandrels to rotate and index about the turret at slower speeds, and thus, produced fewer paper logs per minute. Moreover, these dog systems often caused damage to the cores.

As such, a need currently exists for an improved system for winding paper onto a core. In particular, a need exists for a turret-style system for winding paper onto a core utilizing lighter mandrels to which a core can be securely placed so that the production of logs of paper per minute can increase in comparison to conventional systems.

SUMMARY OF THE INVENTION

The present invention recognizes and addresses the foregoing problems and others experienced in the prior art.

Accordingly, an object of the present invention is to provide an improved mandrel system for winding paper.

It is another object of the present invention to provide a mandrel system that can include a turret assembly having mandrels made from light materials, such as aluminum.

Still another object of the present invention is to provide a mandrel system that can include a turret assembly and a gas circulation system.

Yet another object of the present invention is to provide a gas circulation system for applying suction forces and positive pressure to a mandrel to aid in the positioning and maneuvering of a core on the mandrel during the winding process.

These and other objects of the present invention are achieved by providing a mandrel system that includes a turret assembly. In general, any turret assembly known in the art can be used in the present invention. Specifically, a turret assembly of the present invention can comprise a plurality of mandrels rotatably affixed to a turret capable of indexing about its longitudinal axis. As such, a mandrel of the present invention can be effectively wound with paper as it rotates.

In one embodiment of the present invention, the turret assembly can index the mandrels into a variety of positions or "stations" at which various portions of the winding process can occur. For instance, a core can be loaded onto a mandrel at one position. A paper web can then be wound on a spinning mandrel at another position. Furthermore, a finished roll of wound paper can be removed at yet another position.

In some embodiments, a mandrel system of the present invention can include a gas circulation system that operates in conjunction with the turret assembly. In general, the gas circulation system can allow the flow of a gas, such as air, through one or more mandrels to aid in positioning, loading, and removing a core located on a mandrel during the winding process. In particular, the gas circulation system can, in some instances, provide a suction force to keep the core held into place on the mandrel. Moreover, the gas circulation system can also, in other instances, provide an outwardly force to the core to aid in loading and removal.

Generally, when utilized with a gas circulation system, mandrels of the present invention typically comprise a hollow channel substantially extending the length of the mandrel and an exterior portion containing a plurality of perforations. As a result, air can easily flow through the mandrel via the hollow channel and plurality of perforations. For instance, when applying a suction force, air can be drawn from outside the mandrel through the perforations such that it exits the mandrel through the hollow channel. Moreover, when applying a positive pressure, air can be forced through the hollow channel such that it exits the mandrel via the plurality of perforations.

In general, the perforations can be positioned on the mandrel in any of a variety of patterns and/or locations. For instance, in one embodiment, the perforations can be distributed along the radial axis of the mandrel such that they extend 360° around a cross-section of the mandrel. However, in some instances, the use of less perforations may operate to grip the core more effectively. As such, in some embodiments, the perforations can extend less than 360° around a cross-section of the mandrel. For example, in one embodiment, the perforations can be distributed along the radial axis of the mandrel such that they extend about 180° around a cross-section of the mandrel. In another embodiment, the perforations can form a spiral pattern about the mandrel.

In some embodiments, it may be desired to selectively provide suction forces and/or air pressure at certain positions of the winding process. For instance, it may be desirable to apply a suction force during paper winding, and yet undesirable to apply a suction force during core loading. As a result, one embodiment of a gas circulation system of the present invention includes a mechanism for controlling the air flow through a particular mandrel. For instance, one or more gas flow control devices can be used to control the flow of air throughout the system.

In fact, in one embodiment of the present invention, two gas flow control devices are used to control the flow of air. In particular, the first gas flow control device contains a vacuum passageway and a pressurized air passageway. A vacuum source can communicate with the vacuum passageway such that a suction force is continuously supplied thereto. Moreover, a pressurized air pump can communicate with the pressurized air passageway such that positive pressure is also continuously supplied thereto. In addition, in one embodiment, the first gas flow control device remains stationary with respect to the indexing turret.

Moreover, in this embodiment, a second gas flow control device can be provided that is rotatably affixed to the turret such that it can index in conjunction therewith. The second gas flow control device can comprise a plurality of air passageways that correspond to a particular mandrel. For example, the second gas flow control device can include six air passageways corresponding to six mandrels. Depending on the position of the turret, each air passageway can be placed in communication with the vacuum passageway or pressurized air passageway of the first gas flow control device as the turret and second gas flow control device rotate.

For example, an air passageway corresponding to a mandrel in the core loading position can be placed in communication with the pressurized air passageway of the first gas flow control device such that a positive pressure can be supplied to the mandrel. Moreover, at the same time, an air passageway corresponding to another mandrel in the paper winding position can be placed in communication with the vacuum passageway of the first gas flow control device such that a suction force can be supplied thereto. In some embodiments, it may also be desired that no positive pressure or vacuum be supplied to a particular mandrel. In that case, the air passageway corresponding to the mandrel is not in communication with either the vacuum or pressurized air passageway of the first gas flow control device.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
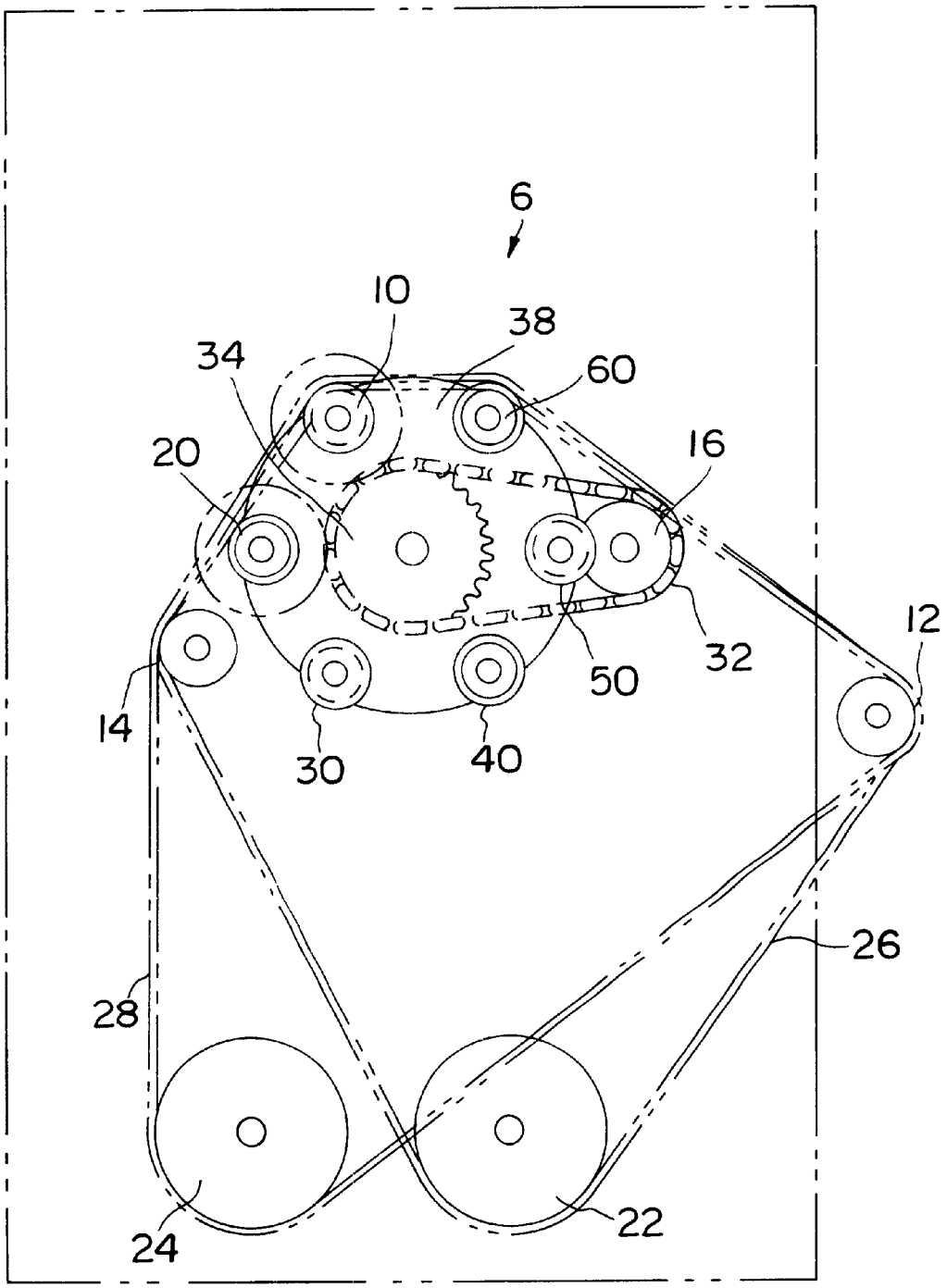
FIG. 1 is a partial front view of one embodiment of a rewinder mandrel system of the present invention.

Repeat use of reference characters in the present specification and drawings is intended to represent the same or analogous features or elements of the invention.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

In general, the present invention is directed to an improved mandrel system for rewinding various types of paper, such as tissue, from large supply rolls into smaller rolls. In particular, the present invention is directed to a mandrel system that can effectively utilize a gas circulation system to aid in the winding process. For instance, it has been discovered that gases can be used to aid in various aspects of the winding process, including adequately positioning, securing, and removing paper rolls on a mandrel. As a result, a system of the present invention can eliminate the need for conventional dog systems that could cause damage to the core or wound product being formed.

Moreover, as a result of the present invention, lighter mandrels, such as those made from aluminum, can be utilized for winding. In fact, it has been discovered that, due to the use of lighter materials, the mandrels can rotate and index about the turret at faster speeds and thus produce more logs of paper per minute than in the past.

As stated, a mandrel system of the present invention used for winding paper generally comprises a turret assembly. Turret assemblies are well known in the art to be useful for winding coreless paper rolls or for winding paper onto a core. In general, turret assemblies often include at least one mandrel that is rotatably affixed to an indexing mechanism. The indexing mechanism, or turret, can rotate a mandrel into a number of positions or stations at which various steps of the winding process can occur. For instance, at one position, the paper can be attached to the mandrel. At another position, the paper can be wound around the mandrel. And, at yet another position, the wound paper roll can be removed from the mandrel.

According to the present invention, any turret assembly known in the art is suitable for use in the present invention.

Examples of various turret assemblies that can be used in the present invention include, but are not limited to, the turret assemblies described in U.S. Pat. No. 4,133,495 to Dowd; U.S. Pat. No. 5,337,968 to De Bin et al.; and U.S. Pat. No. 5,797,559 to Coffey, which are incorporated herein by reference. One particular embodiment of a turret assembly that can used in the present invention is depicted in FIG. 14. However, as stated, it should be understood that the embodiment depicted in FIG. 14 and described herein is but one example of a suitable turret assembly, and that other turret assemblies are equally suitable for use in the present invention.

Figure 4:
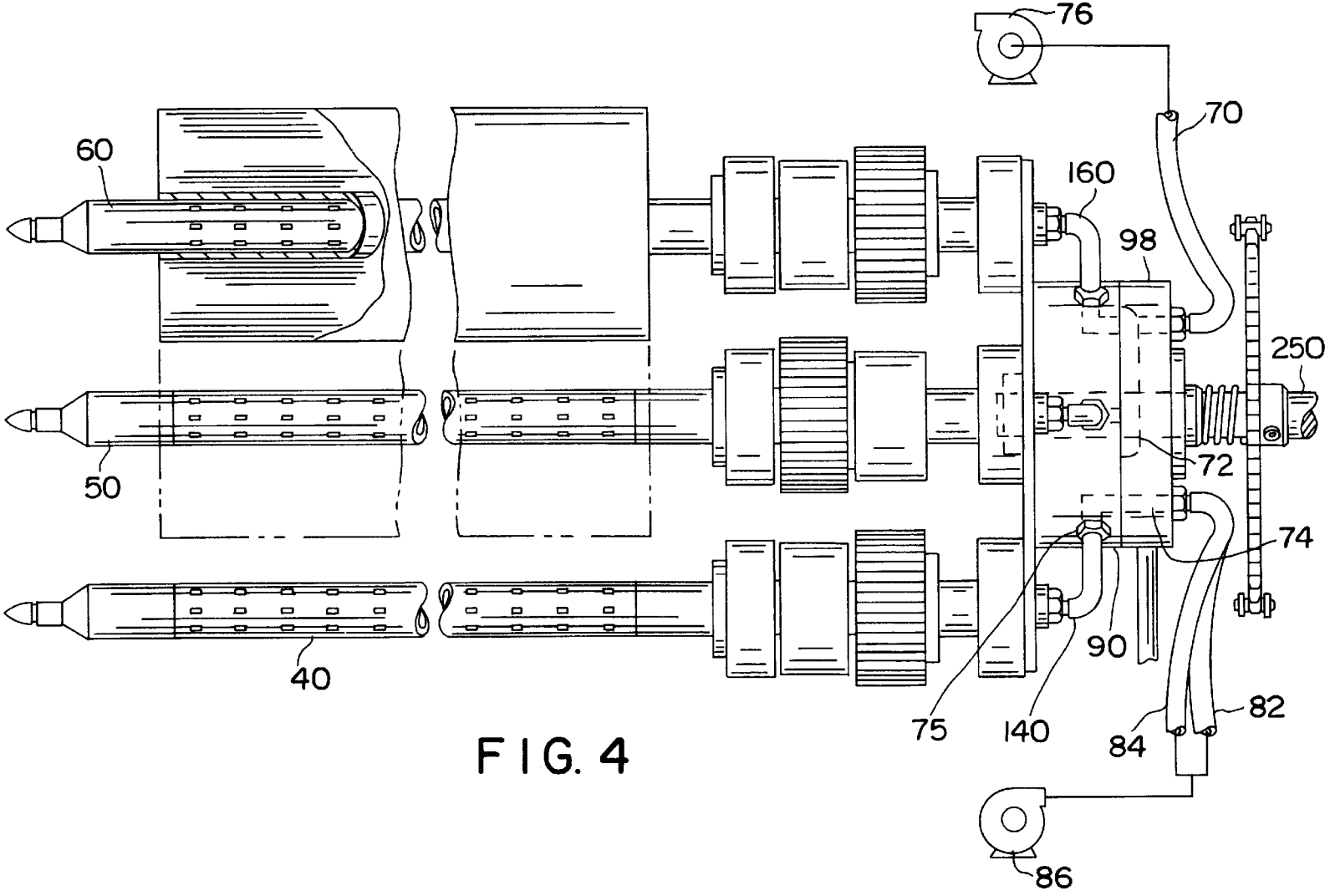
FIG. 4 is a cross-sectional view of the embodiment depicted in FIG. 3 taken across a line 4—4.

In this regard, Referring to FIG. 1, one embodiment of a turret assembly of the present invention is illustrated. As shown, a turret assembly 6 can include a turret 38 attached to various mandrels. As stated above, turret 38 can generally be indexed into a variety of positions during the winding process. For instance, as shown in FIG. 4, the indexing can occur by rotating the turret about its longitudinal axis, which is axially carried on shaft 250. This rotation of the turret can be accomplished by any of a variety of methods known in the art. For example, as shown in FIG. 1, turret 38 can be indexed through the rotation of gear 34. In this embodiment, the rotation of gear 34 is effected by belt 32, which is engaged around pulley 16. Thus, as a result of the rotation of pulley 16 by a driving mechanism (not shown), turret 38 can be indexed into a variety of positions.

Figure 2:
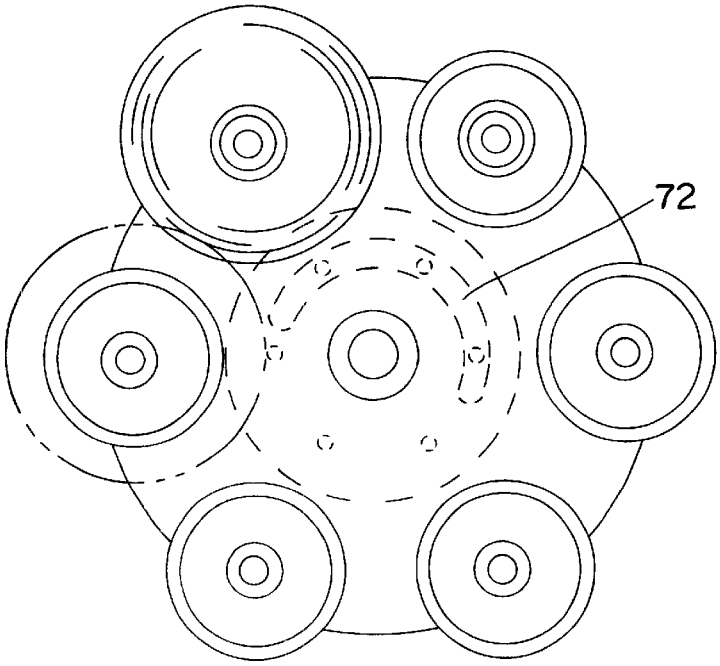
FIG. 2 is a partial front view of a turret assembly of one embodiment of a rewinder mandrel system of the present invention.
Figure 3:
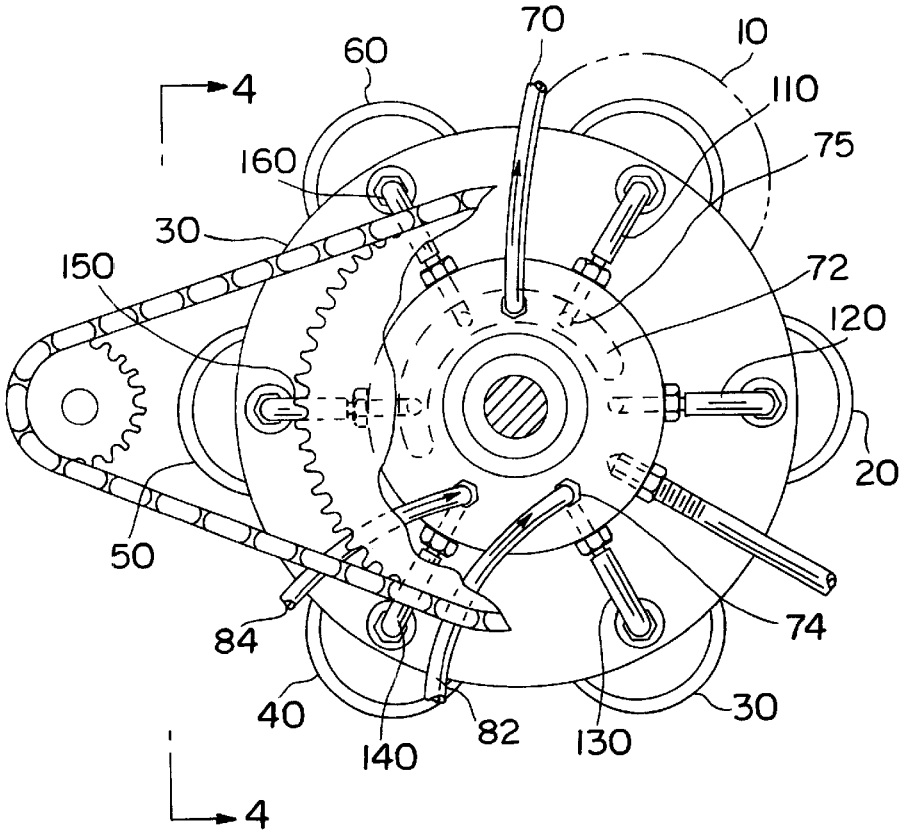
FIG. 3 is a partial back view of a turret assembly of one embodiment of a rewinder mandrel system of the present invention.

In accordance with the present invention, the turret assembly can also include at least one mandrel for winding paper that is rotatably affixed to the turret. For instance, as shown in FIGS. 1–3, six mandrels 10, 20, 30, 40, 50, and 60 can be rotatably affixed to turret 38. Although turret assembly 6 is depicted in FIG. 1 as including six mandrels, it should be understood that only one mandrel, or any number of mandrels greater than one, can also be used in the present invention.

Accordingly, one embodiment for winding paper onto a core utilizing turret assembly 6 will now be described. It should be understood, however, that the following description is for illustrative purposes only, and that any other method for winding paper can be used with a mandrel system of the present invention.

Figure 5:
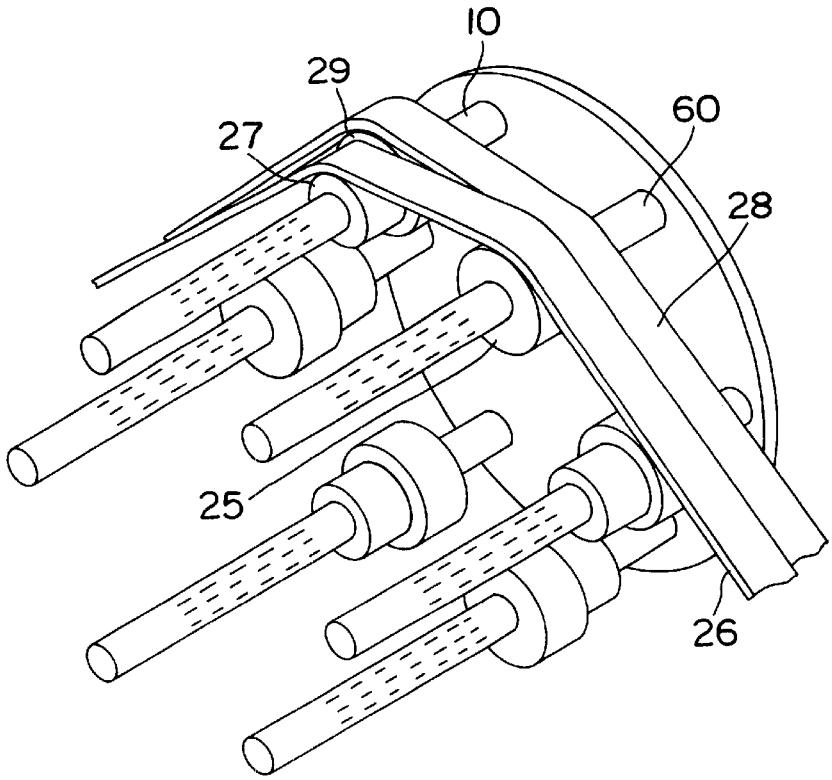
FIG. 5 is a partial perspective view of one embodiment of a turret assembly of the present invention.
Figure 6A:
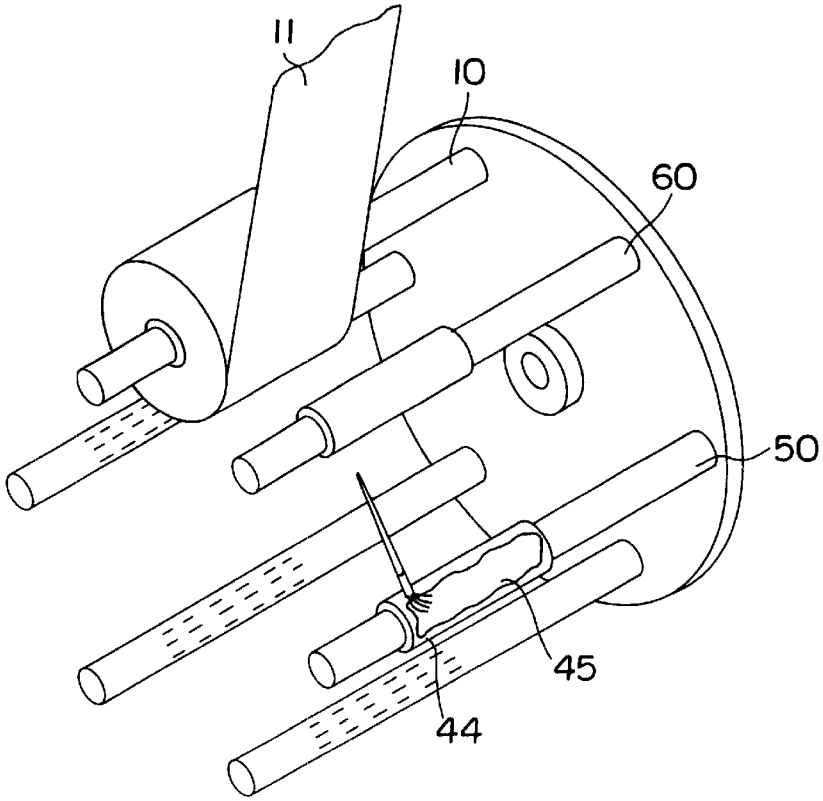
FIGS. 6A–6D are partial perspective views of one embodiment of the present invention for winding a paper roll on a mandrel.
Figure 6B:
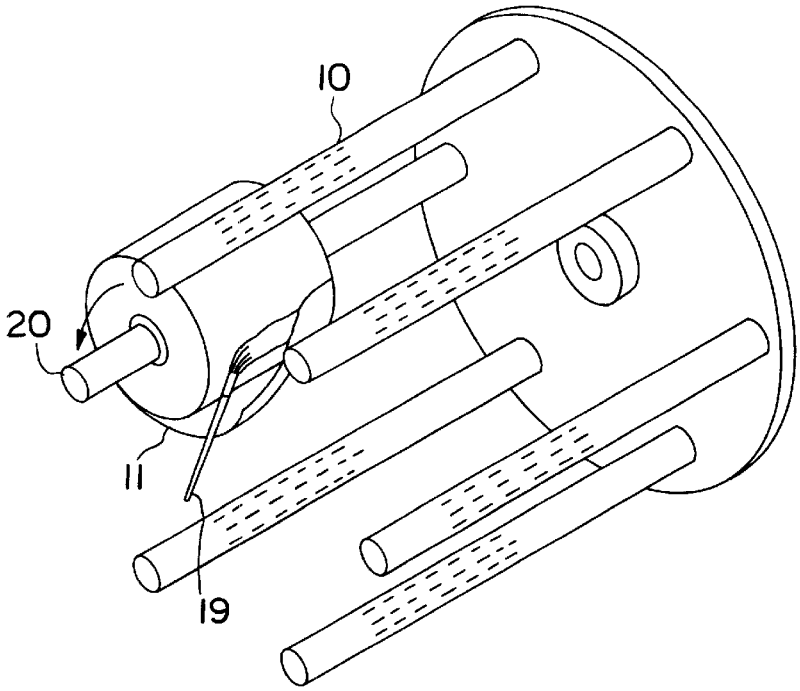
Figure 6C:
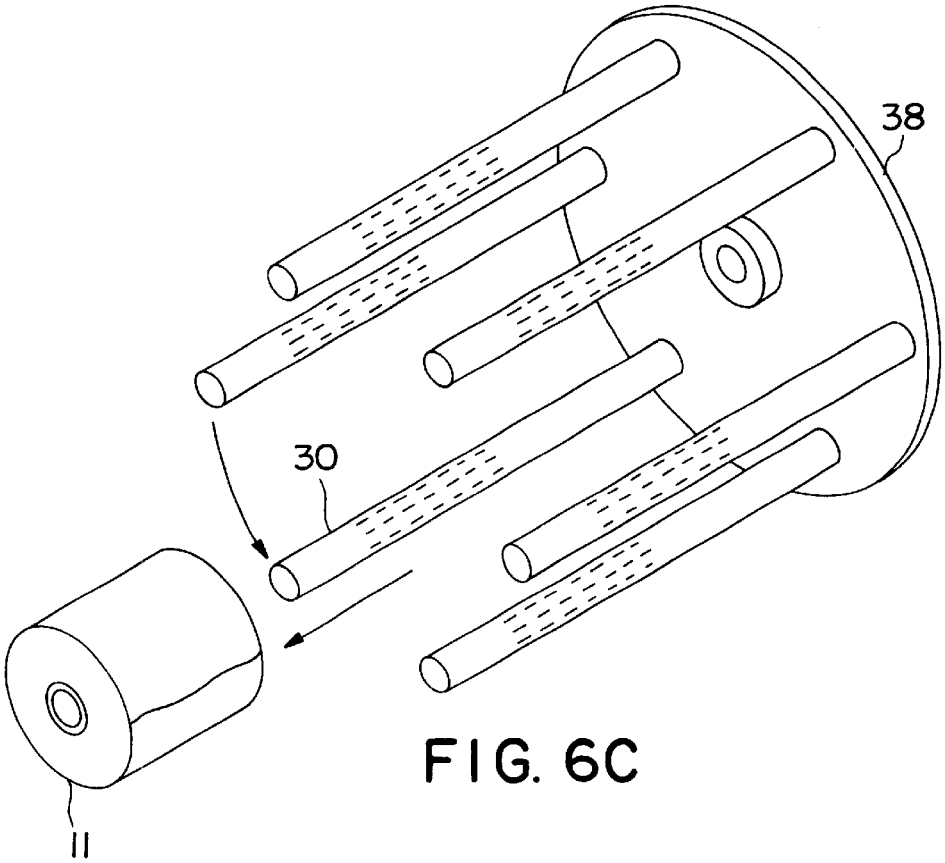
Figure 6D:
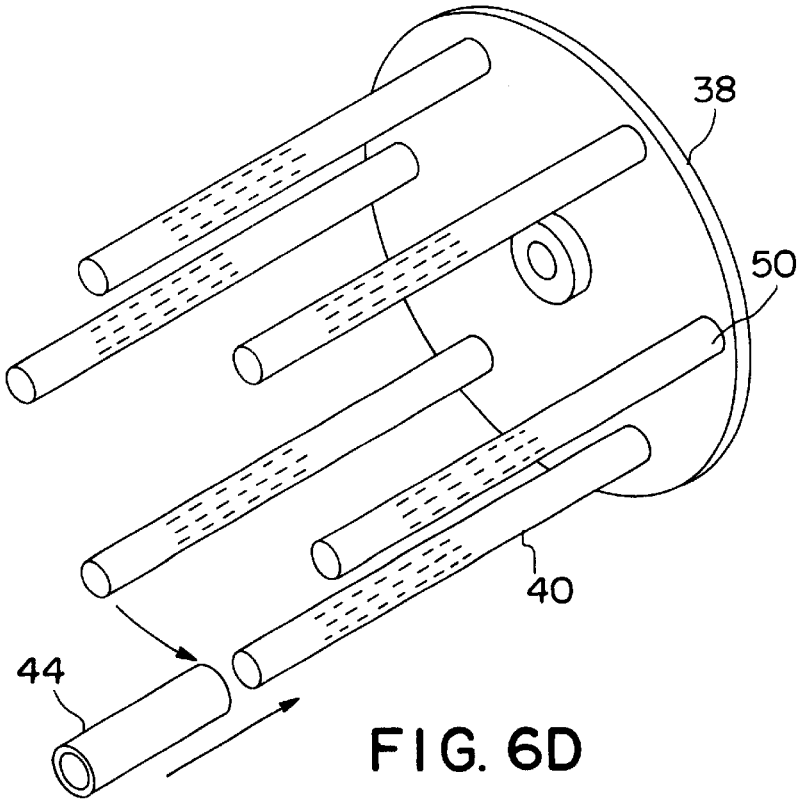

As shown in FIG. 6D, the winding process can be initiated by first placing a core 44 onto mandrel 40 according to any method known in the art. The position of mandrel 40 in the embodiments depicted in FIGS. 1–7 can also be described as the "core loading position" of turret 38. Once core 44 is placed onto mandrel 40, turret 38 can then be indexed into an "adhesive application position", which is the position occupied by mandrel 50 in the embodiments depicted by FIGS. 1–7. In particular, as illustrated in FIG. 6A, an adhesive 45 can be applied by any method known in the art to core 44. Generally, an adhesive used in the present invention can comprise any of a variety of materials, such as glue, known to adhere paper to a surface. Although not necessarily required, such an adhesive facilitates attachment of the paper web onto a core.

Once adhesive 45 is applied to core 44, mandrel 40 can be indexed by turret 38 into the "prespin position", which is the position occupied by mandrel 60 in the embodiments depicted by FIGS. 1–7. At the "prespin position", the mandrel can be rotated to ensure that the mandrel achieves a certain rotational speed before a paper web is wound thereon. In one embodiment, as shown in FIG. 6A, mandrel 60, for example, can be "prespun" in a clockwise direction.

In general, a mandrel of the present invention can be rotated by any manner known in the art. For example, as shown in FIG. 1, drive motor pulleys 22 and 24 can be utilized to spin the mandrels. Specifically, motor pulleys 22 and 24 can engage drive belts 26 and 28, respectively, which are wrapped around secondary pulleys 12 and 14. In one embodiment, as illustrated in FIG. 5, motor pulley 22 can maneuver drive belt 26 such that it movably contacts pulley engagement device 27, thereby causing mandrel 10 to spin, while simultaneously movably contacting pulley engagement device 25, thereby causing mandrel 60 to spin. Moreover, to assist drive belt 26, motor pulley 24 can maneuver drive belt 28 such that it movably contacts pulley engagement device 29, thereby causing mandrel 10 to spin, while simultaneously movably contacting another pulley engagement device (not shown), thereby causing mandrel 60 to spin.

As illustrated in FIG. 5, one embodiment of the present invention also provides for mandrels having pulley engagement devices of different sizes for alternating mandrels such that drive belts 26 and 28 remain staggered throughout the winding process. For instance, as shown in FIG. 5, pulley engagement device 27 of mandrel 10 can have a smaller diameter than a corresponding pulley engagement device 25 for an adjacent mandrel 60.

Once initially rotated at the "prespin position", the mandrel can then be indexed by turret 38 into the "winding position", which is the position occupied by mandrel 10 in the embodiments depicted by FIGS. 1–7. The rotational speed of the mandrel imparted at the "prespin position" is generally greater than the feed speed of the paper web such that, as the rotating mandrel is indexed into the "winding position", the paper web can wind around the mandrel. Moreover, as shown in FIG. 6A, mandrel 10, for example, can be further rotated in a clockwise direction, while in the "winding position", by drive belts 26 and 28 such that paper web 11 can be wound thereon. In some embodiments, the rotational speed of mandrel 10 can be maintained at a substantially constant rate from the time that it first contacts the leading edge of paper web 11 until the end of the winding period.

After paper web 11 is wound onto the mandrel, it can then be further indexed by turret 38 into a "tail seal position", which is the position occupied by mandrel 20 in the embodiments depicted by FIGS. 1–7. At the "tail seal position", the unattached portions of paper web 11 can be sealed to the roll of paper via a sealing device 19. In some embodiments, for example, sealing device 19 can be configured to apply glue or some other adhesive to the paper web such that the tail can be sealed thereto. As shown in FIG. 1, mandrel 20 can also be rotated by drive belt 22 as described above. An external roll (not shown) can also be used for rotating mandrel 20 at the "tail seal position" of this embodiment. As such, mandrel 20 can rotate at a slower speed, which can aid in the sealing process.

Once sealed, the finished roll of paper can then be removed. In some embodiments, as depicted in FIG. 6C, a mandrel containing a finished roll of paper can be indexed by turret 38 into a "removal position", which is the position occupied by mandrel 30 in the embodiments depicted by FIGS. 1–7. As illustrated by FIG. 6C, a finished roll of paper web 11 can be axially removed from mandrel 30 by any method known in the art.

Figure 7A:
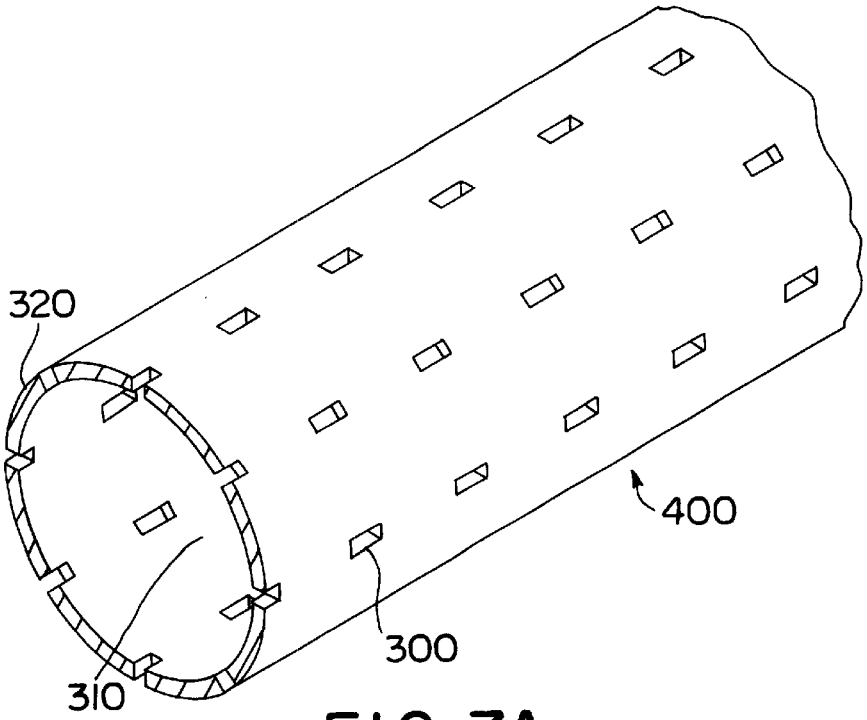
FIGS. 7A–7C are perspective views of various embodiments of a mandrel of the present invention.
Figure 8A:
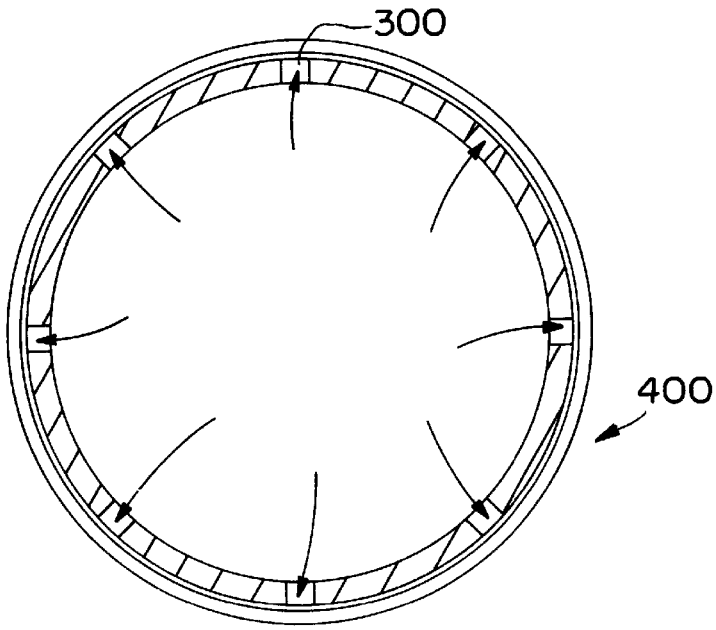
FIGS. 8A–8B are cross-sectional views of one embodiment of a mandrel of the present invention.

To aid in rewinding paper from a large roll into smaller rolls, one embodiment of a mandrel system of the present invention includes a gas circulation system that can operate in conjunction with the turret assembly. When utilizing a gas circulation system, a mandrel of the present invention can typically be provided with a hollow channel having an exterior portion containing various holes or perforations through which air can easily flow. For example, in one embodiment, as shown in FIG. 7A, a mandrel generally 400 is depicted having a longitudinal channel 310 that substantially extends the length of the mandrel. Moreover, mandrel 400 also includes an outer wall 320 that is provided with perforations 300 distributed along the radial axis of the mandrel such that perforations 300 extend 360° around a cross-section of mandrel 400. In one embodiment, air can be circulated through a mandrel at a positive pressure to aid in the loading and removal of paper rolls from the mandrel. Positive pressure can generally allow an outwardly force to be applied to the core or paper roll located on a mandrel and thus facilitate loading and removal of paper from the mandrel. For example, as shown in FIG. 8A, one embodiment of the present invention includes a system that can circulate air at a positive pressure through perforations 300 of mandrel 400 such that an outwardly force (indicated by arrows) can be applied to a core or paper roll located on mandrel 400.

Figure 8B:
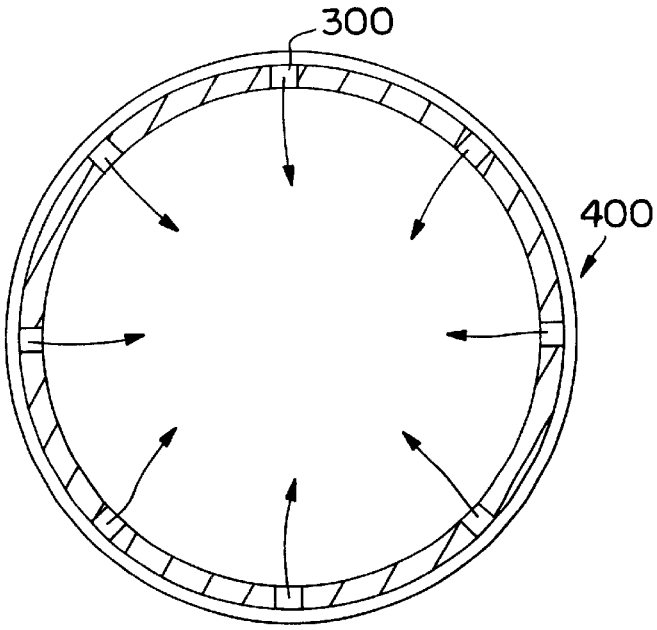

Moreover, in another embodiment, air can be drawn through a mandrel to provide a suction force to a core or paper roll located on the mandrel to keep the roll in position during the winding process. For example, as shown in FIG. 8B, air can be drawn through perforations 300 of mandrel 400 such that a suction force (indicated by arrows) can be applied to a core or paper roll located on mandrel 400.

Figure 7B:
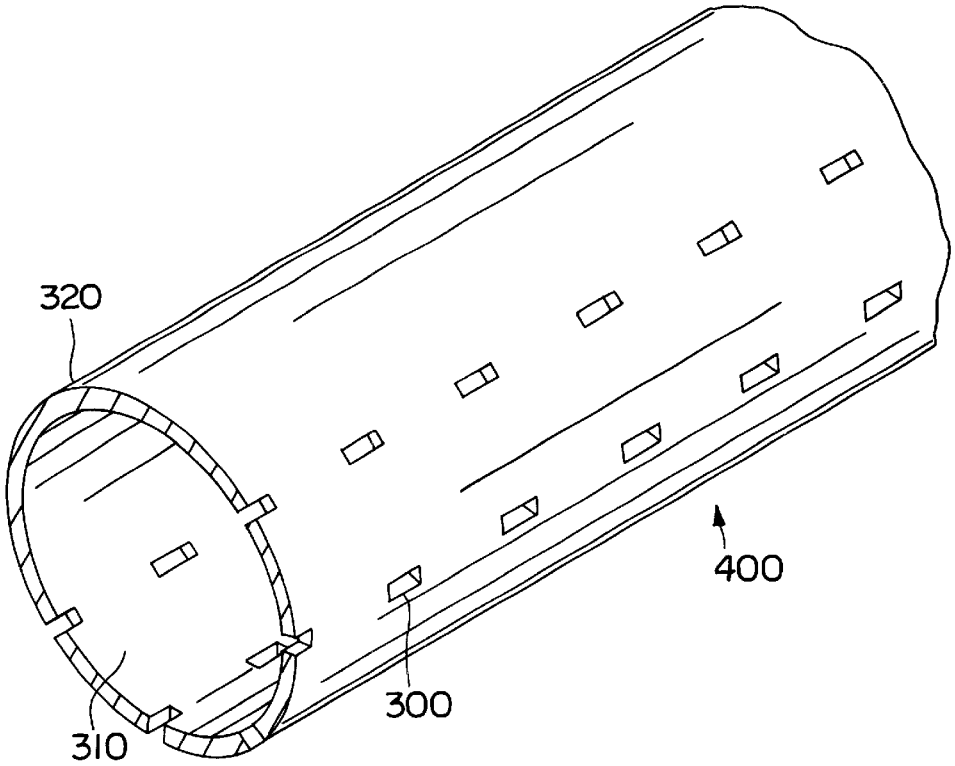
Figure 7C:
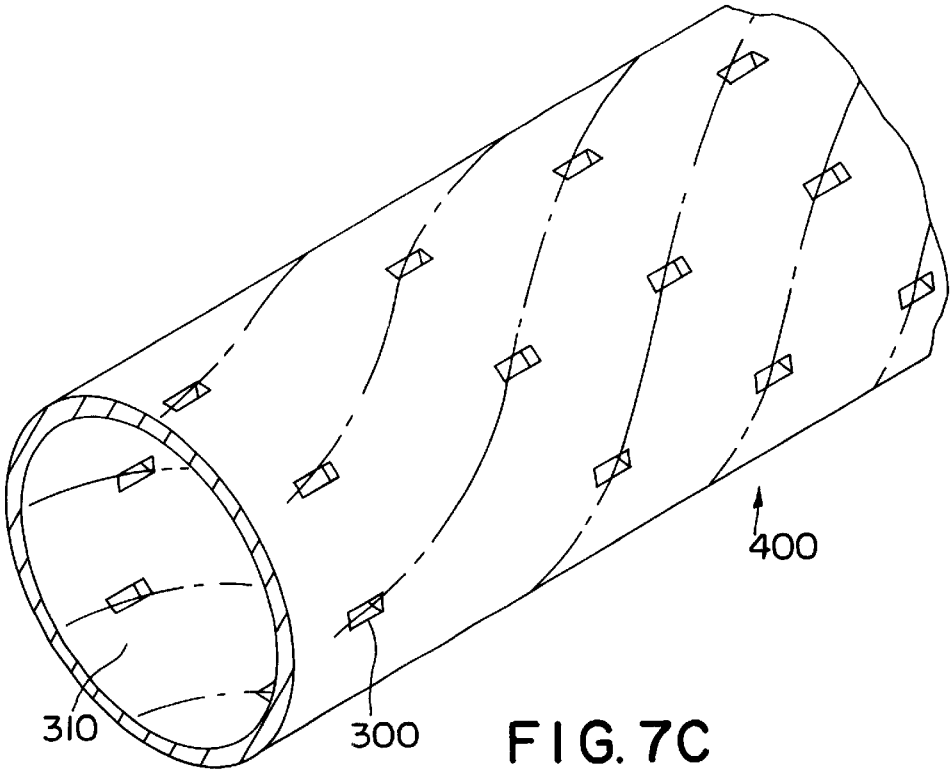

In some embodiments, it may also be desired to use perforations that extend less than 360° around any cross-section of the mandrel. For instance, as shown in FIG. 7B, outer wall 320 of mandrel 400 can include perforations 300 distributed along the radial axis of the mandrel such that perforations 300 extend about 180° around a cross section of mandrel 400. Moreover, in another embodiment, as shown in FIG. 7C, outer wall 320 of mandrel 400 can include perforations 300 distributed along the radial axis of the mandrel in a spiral pattern. In some instances, using less perforations allows the core to be better gripped and positioned on the mandrel.

In particular, for most applications the paper core placed on the mandrel will have a circumference slightly greater than the circumference of the mandrel. In some applications, if the perforations were to extend around the entire circumference of the mandrel, a paper core placed on the mandrel may either be unevenly held or may tend to collapse when a suction force is applied. Utilizing perforations that do not extend around the entire circumference of the mandrel can allow the mandrel to better hold the core and can also allow some compensation for the larger diameter of the core.

The circulation of air through a mandrel of the present invention can generally be accomplished through the use of any gas circulation system known in the art. Referring to FIGS. 2–4, one embodiment of a gas circulation system of the present invention is illustrated. As shown in FIG. 4, a vacuum source 76 can be utilized to provide a suction force to the mandrels of the present invention. Generally, vacuum source 76 can comprise any mechanism known in the art to be capable of supplying a suction force, such as a vacuum pump. In one embodiment, vacuum source 76 can provide a suction force to a core located on mandrel 60, for example, by drawing outside air through the perforations of mandrel 60, into conduit 160, and through vacuum hose 70. Although air flowing through vacuum hose 70 is depicted as exiting to the atmosphere, it can also be recirculated for applying a positive pressure to other sections of the gas circulation system.

In addition to vacuum source 76, air at a positive pressure can also be supplied by an air source 86 in accordance with the present invention. Generally, air source 86 can comprise any mechanism known in the art to be capable of supplying a positive pressure, such as a pressurized pump. In one embodiment, air source 86 can provide a positive pressure to mandrel 40, for example, by forcing air through hose 84 into conduit 140 such that it then flows through the channel and perforations of mandrel 40.

In many cases, a suction force and a positive air pressure may only be desired at certain "positions" of the winding process. For example, a suction force can often be useful when applying an adhesive to the core, prespinning the core, and/or winding paper onto the core to help control the position of the core on the mandrel. However, a suction force may conversely be undesirable in other positions of the winding process, such as when loading or removing a core from a mandrel, because a suction force could make it difficult to maneuver the core or paper roll as needed. In fact, in these positions of the winding process, it may instead be desirable to apply a positive pressure to the core. Consequently, a gas circulation system of the present invention can, in some embodiments, be provided with a mechanism for controlling the flow of gas so as to control the type of force applied at each winding position.

Referring again to FIGS. 2–4, one embodiment of a gas circulation system provided with a mechanism for controlling gas flow is illustrated. In this embodiment, gas flow control devices 90 and 98 can be utilized to control the flow of air through a system of the present invention. Although the use of two gas flow control devices, such as valves, is shown and described herein, it should be understood that any number of gas control devices can be adapted to provide adequate gas flow control in a system of the present invention.

As shown in FIG. 4, gas flow control device 90 can be rotatably affixed to turret 38 so that it moves in conjunction with turret 38. Gas flow control device 90 can comprise a plurality of holes that typically correspond to the number of mandrels. For example, as shown in FIG. 3, gas flow control device 90 includes six holes 75 that correspond with each mandrel. Each hole 75 is connected to an air passageway that communicates with a particular mandrel. For instance, as shown in FIGS. 3–4, one hole of gas flow control device 90 can communicate with air passageway 140 corresponding to mandrel 40. Moreover, another hole of gas flow control device 90 can communicate with air passageway 160 corresponding to mandrel 60.

One embodiment of a gas circulation system of the present invention can also include gas flow control device 98. As shown in FIGS. 2–4, gas flow control 98 can include a vacuum passageway 72 and two stationary air passageways 74 to help control the flow of air. Moreover, gas flow control device 98 can also be placed in communication with gas flow control device 90. In particular, gas flow control device 98 typically remains stationary with respect to turret 38 and gas flow control device 90. In some embodiments, for example, gas flow control device 98 can be affixed to the ground via a frame or other device (not shown) of the turret assembly.

Because gas flow control device 90 rotates with turret 38, while gas flow control device 98 remains stationary, vacuum and pressurized air can be continuously applied to multiple mandrels in a system of the present invention based on the position of each mandrel. In particular, vacuum source 76 can continuously draw air through vacuum passageway 72 of gas flow control device 98. Thus, as gas flow control device 90 rotates, various passageways of device 90 corresponding to a certain mandrel can be placed in communication with stationary vacuum passageway 72. Furthermore, positive air pressure can also be continuously applied by air source 86 to gas flow control device 98 via stationary air passageways 74. Thus, as gas flow control device further rotates, various holes 75 of device 90 corresponding to a certain mandrel can be placed in communication with stationary passageways 74.

To better illustrate the operation of a gas circulation system of the present invention, the embodiments illustrated in FIGS. 2–4 will now be described in more detail. As shown, mandrel 40 is located in the "core loading" position at which a core (not shown) is being loaded thereon. To facilitate loading, a positive pressure can be supplied to the mandrel by air source 86. In particular, when turret 38 indexes mandrel 40 into the "core loading position", air passageway 140 of mandrel 40 can be placed in communication with stationary air passageway 74 via hole 75. While in this position, air source 86 can supply a positive air pressure to mandrel 40 to aid in the loading process.

After loading is completed, turret 38 can then index into the "adhesive application position", which is occupied by mandrel 50. In this position, a suction force can be applied by vacuum source 76 to mandrel 50 to keep the core located thereon in position during adhesive application. In particular, when turret 38 indexes the mandrel into the "adhesive application position", air passageway 150 of mandrel 50 can be placed in communication with stationary vacuum passageway 72 of flow control device 98. While in this position, vacuum source 76 can therefore supply a suction force to the mandrel to keep the core properly positioned during winding.

As described in more detail above, turret 38 can also be indexed to a variety of other winding positions. For instance, as shown in FIG. 3, mandrels 60 and 10 can also be placed in communication with vacuum passageway 72 via air passageways 160 and 110, respectively, such that a suction force can be applied to help keep the core in position while winding paper thereon. Moreover, air passageway 130 of mandrel 30 ("removal position") can be placed in communication with stationary air passageway 74 such that a positive air pressure can be applied to aid in removal of the core. In some embodiments, a particular position may require neither a suction force nor a positive pressure. For example, as shown in FIG. 3, air passageway 120 of mandrel 20 ("tail seal position") is not in communication with vacuum passageway 72 or stationary air passageways 74.

Although a gas circulation system of the present invention has been described herein with respect to one method of winding paper onto a core, it should also be understood that other methods of winding paper are equally suitable for use in the present invention. For example, in some embodiments, it may be desired to apply a suction force to mandrels at different positions, to refrain from using positive air pressure, to use gas flow at only one position, etc. Moreover, in some embodiments, it may not be necessary to utilize any gas flow to aid in the winding process.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A mandrel system for winding paper onto a core comprising:

a turret capable of indexing about a longitudinal axis;

a mandrel rotatably affixed to said turret, said mandrel defining a longitudinal channel substantially extending the length of said mandrel, said mandrel further comprising a plurality of perforations distributed along a radial axis of said mandrel in communication with said longitudinal channel, wherein said perforations extend less than 360° around a cross-section of said mandrel and wherein said mandrel is configured to receive a suction force for holding a roll of paper thereon and a pressurized force to aid in maneuvering said core along said mandrel;

a first gas flow control device defining a vacuum passageway and a pressurized air passageway, said first gas flow control device being positioned such that said first gas flow control device remains stationary with respect to said turret;

a second gas flow control device in rotational communication with said turret such that said second gas flow control device is moveable in conjunction with said turret, said second gas flow control device defining an air passageway in communication with said longitudinal channel of said mandrel, said second gas flow control device being positioned adjacent to said first gas flow control device;

wherein said second gas flow control device is selectively rotatable by said turret to a first position wherein said air passageway of said second gas flow control device is placed in communication with said vacuum passageway of said first gas flow control device such that said suction force is capable of being communicated through said plurality of perforations and said longitudinal channel; and wherein said second gas flow control device is further selectively rotatable by said turret to a second position wherein said air passageway of said second gas flow control device is placed in communication with said pressurized air passageway of said first gas flow control device such that said pressurized force is capable of being communicated through said plurality of perforations and said longitudinal channel.

2. A mandrel system as defined in claim 1, wherein said perforations extend less than about 180° around a cross-section of said mandrel.

3. A mandrel system as defined in claim 1, wherein said perforations are located along said mandrel in a spiral pattern.

4. A mandrel system as defined in claim 1, wherein said suction force is provided by a vacuum pump.

5. A mandrel system as defined in claim 4, wherein said vacuum pump is in communication with said vacuum passageway of said first gas flow control device.

6. A mandrel system as defined in claim 1, wherein said pressurized force is provided by a pressurized air pump.

7. A mandrel system as defined in claim 6, wherein said pressurized air pump is in communication with said pressurized air passageway of said first gas flow control device.

8. A method of winding paper onto a core, said method comprising:

providing a turret capable of indexing about a longitudinal axis;

providing a mandrel rotatably affixed to said turret, said mandrel defining a longitudinal channel substantially extending the length of said mandrel, said mandrel further comprising a plurality of perforations in communication with said longitudinal channel, said plurality of perforations being distributed along a radial axis of said mandrel in a manner such that said perforations extend less than 360° around a cross-section of said mandrel;

providing a first gas flow control device that defines a vacuum passageway and a pressurized air passageway, said first gas flow control device being positioned such that said first gas flow control device remains stationary with respect to said turret;

positioning a second gas flow control device adjacent to said first gas flow control device, said second gas flow control device being in rotational communication with said turret such that said second gas flow control device is moveable in conjunction with said turret, said second gas flow control device defining an air passageway in communication with said longitudinal channel of said mandrel;

loading a core onto said mandrel at a first turret position, wherein said air passageway of said second gas flow control device is in communication with said vacuum passageway of said first gas flow control device at said first turret position;

applying a suction force to said core while said turret is indexed to said first turret position, said suction force being provided by flowing air through said perforations and said longitudinal channel of said mandrel;

indexing said turret to a second turret position, wherein said air passageway of said second gas flow control device is in communication with said pressurized air passageway of said first gas flow control device in said second turret position; and applying a pressurized force to said core while said turret is indexed to said second turret position, said pressurized force being applied by flowing air through said plurality of perforations and said longitudinal channel of said mandrel.

9. A method as defined in claim 8, wherein said suction force is provided by a vacuum pump.

10. A method as defined in claim 9, wherein said vacuum pump is in communication with said vacuum passageway of said first gas flow control device.

11. A method as defined in claim 8, wherein said pressurized force is provided by a pressurized air pump.

12. A method as defined in claim 11, wherein said pressurized air pump is in communication with said pressurized air passageway of said first gas flow control device.

13. A method as defined in claim 8, wherein said perforations extend less than about 180° around a cross-section of said mandrel.

14. A method as defined in claim 8, wherein said perforations are located along said mandrel in a spiral pattern.

* * * * *